United States Patent [19]

Cutler

[11] 4,418,438

[45] Dec. 6, 1983

[54] ROTARY CARPET CLEANING PAD

[76] Inventor: Barry L. Cutler, 7 Stanford Ct., E. Windsor, N.J. 08520

[21] Appl. No.: 404,602

[22] Filed: Aug. 2, 1982

[51] Int. Cl.[3] ..... A47L 11/14

[52] U.S. Cl. ..... 15/230; 15/98; 15/230.16

[58] Field of Search ..... 15/230, 230.14, 230.15, 15/230.16, 230.18, 230.19, 98, 385

[56] References Cited

U.S. PATENT DOCUMENTS 3,181,193 5/1965 Nobles et al. ..... 15/230 X 3,728,075 4/1973 Cannan ..... 15/230.16 X 4,321,095 3/1982 Argo et al. ..... 15/98

*Primary Examiner*—Edward L. Roberts

*Attorney, Agent, or Firm*—Raymond Underwood

[57] ABSTRACT

A carpet cleaning pad to go underneath a rotary floor cleaning machine is of disc or circular outline; it is made up of a base sheet material which supports radial strips of fiber bristles and also an annular strip of fiber bristles around the periphery of the disc, the remainder of the space within the annular strip being filled in with firm loops of strand material to form a bed of hooked rug solidity.

7 Claims, 3 Drawing Figures

ROTARY CARPET CLEANING PAD

Figure 1:
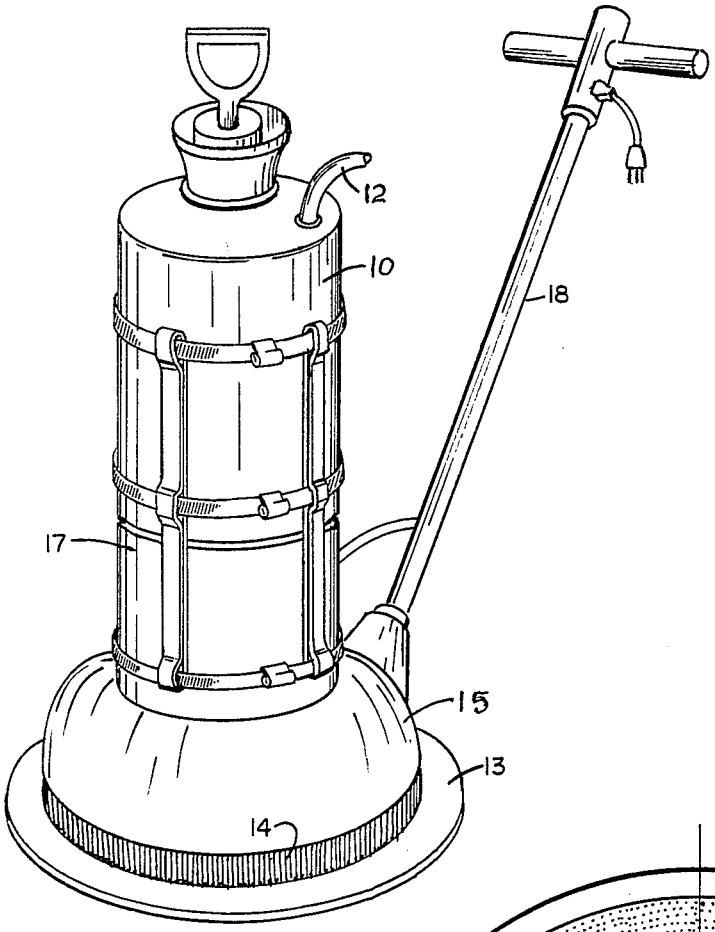

This invention relates to cleaning pads and particularly to the pads which are used in conjunction with rotary floor machines used for cleaning carpets.

The general type of cleaning machine and pad to which the invention relates is illustrated and described in my U.S. Pat. No. 4,295,622 entitled Framework Holder for Attaching Container to Floor Machines which issued on Oct. 20, 1981; its disclosure is hereby incorporated herein by this reference. It shows a bell housing at 15 to which is attached a handle 18 for manipulating the cleaning machine in various directions over and around the floor or carpet.

The feature of that patent is the releasable framework means for holding a tank 10 which contains cleaning fluid, on and above the motor housing 17. This feature is not in any way necessary to practice the present invention but the pad of this invention can, for instance, be used on that machine. That machine shows at 14 the bristles of the drive brush which is rotated about a vertical axis by the motor.

The brush bristles bear on a pad 13 and the present invention constitutes an improvement in such a pad. This pad bears directly on the floor or carpet and applies the cleaning fluid to them and the combined rotation and lateral and forward movements of the pad performs the cleaning and scrubbing action. As herein used, the word "pad" is sometimes referred to as the "bonnets" which are used for the same purpose under the usual drive brush.

The pads which are generally in use are more or less of a mop-like or shag-like consistency in that the surface which bears on the floor is soft and yielding. They can be described as having a shaggy surface and not a firm surface. The trouble with such conventional pads is that they lack the aggressive stripping and scrubbing fibers which are necessary to perform an effective cleaning action. Such conventional pads are about as effective as using a conventional mop over the surface of a rug as no worthwhile deep cleaning action is achieved.

Some newer pads have been formed with firm surfaces to bear on the surface to be cleaned and these pads are made by tightly looping strands of strong synthetic material through a base sheet. The resulting pad is much like a hooked rug as its working surface is quite firm. Such a pad has the advantage of actively cleaning the carpet and picking up in the pad a considerable amount of the dirt which was lodged deep in the carpet or rug.

Some other newer pads have included strips of fibers which are much like the consistency of conventional hairbrushes. Such fibers possess an even better scrubbing action but they lack the feature of picking up and retaining the dirt which is released from the rug or carpet. These strips or bands of fibers are radially disposed or approximately so.

The present invention involves the discovery that an unexpected cleaning action is accomplished with a floor cleaning pad which is basically firm and fabricated like a hooked rug and has radial strips of brushes and also arcuate strips of fibers close to the circular edge. The radial bands or strips of fibers serve a scrubbing purpose, the arcuate bands or strips of fibers serve a stripping action and the firm hooked-rug like portions of the pad serve to further scrub the floor or carpet and at the same time serve to absorb and retain the dirt which is released from the floor or carpet.

Figure 3:
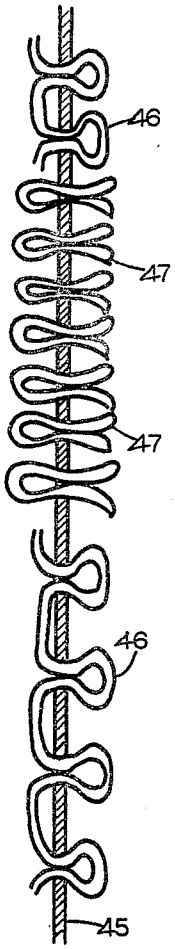
Figure 2:
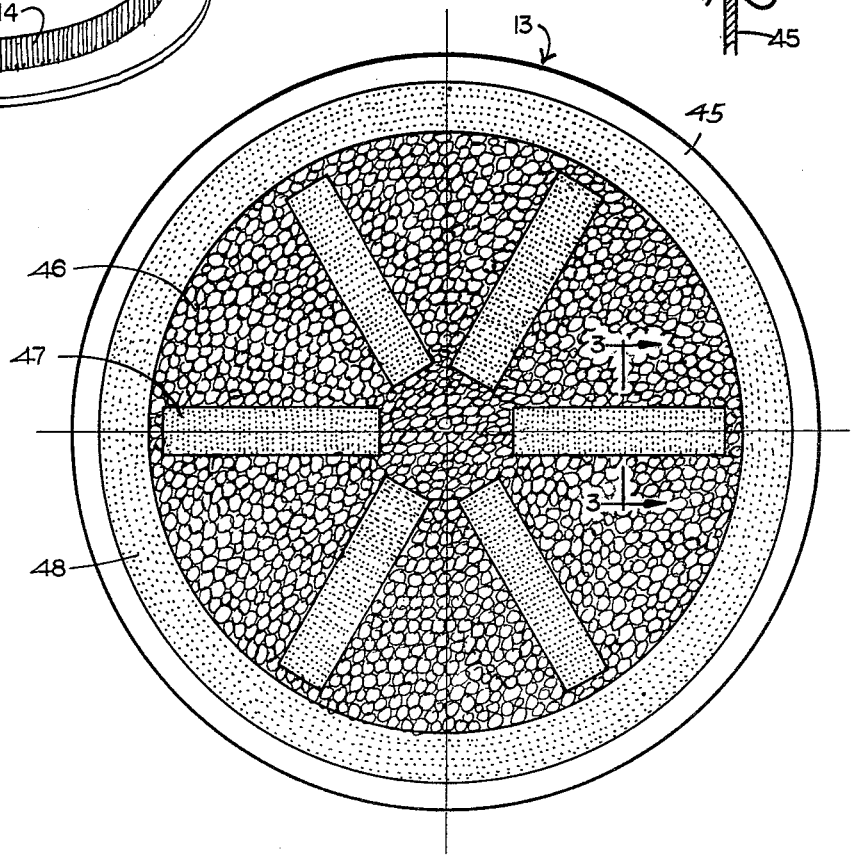

A preferred embodiment of the invention is illustrated in the drawings in which:

FIG. 1 shows the floor machine of my above mentioned patent and it is representative of these machines in general, FIG. 2 shows the under side or working side of the pad and FIG. 3 is a section on the line 3—3 of FIG. 2.

FIG. 1 shows at 13 the pad of the present invention and it corresponds in its manner of use to the pad 13 of my aforesaid U.S. Pat. No. 4,295,622. The pertinent parts of the machine itself have the same reference numeral in this drawing and in my patent and the description in my patent is hereby incorporated herein by this reference as is stated above. That is, for a complete description of the illustration of FIG. 1, the specification of the patent should be examined.

Briefly, it should be here stated that the electric motor housing is shown at 17, the manipulating handle is shown at 18, the brush which is rotated by the motor is shown at 14 and the bell housing over the brush is shown at 15. The brush 14 frictionally drives and rotates the flat pad 13.

The pad 13 is of disc or circular shape and it should be slightly larger than the brush to which it is to be applied. The pad has a base sheet of material 45 which is preferably a strong non-woven fabric; a strong burlap or burlap-like synthetic fabric is generally used. It should be so firm and tightly constructed that it will retain in it strands of material which are looped back and forth through it. These looped strands form the pile.

The pile is of two kinds as is shown on an enlarged scale in FIGS. 2 and 3. One form of pile, shown at 46, is of the hooked rug type as it is made of flexible strands of material which are repeatedly hooked into the base sheet 45. These strands should be of strong, tough synthetic materials which will withstand the wear and tear of rubbing on the surface to be cleaned.

The other form of pile, shown at 47, is made of bristles or relatively stiff fibers which are more or less like those in a hair brush. FIG. 3 shows a representative way of holding them in the base sheet 45 and it is important to note that the free ends of the bristle fibers are on the same side of the base sheet 45 as the portions of the loops 46 which are formed outside of the same hole through sheet 45. This is the working side of the pad.

An important feature of the invention is that there are radial rows 47, see FIG. 2, of the bristle fibers, and also a circular row 48 of the same bristles. Six radial rows 47 are here shown as this is preferred but there could be a few more or less radial rows. The width of the radial rows or strips is not critical but they preferably are from five to eight percent of the diameter of the pad.

The circular row 48 of bristles should be more or less of the same width as radial rows 47. A complete circular row is not essential as there may be a few gaps in the circle of bristle fibers so that the fibers are in partial arcs which are disposed in a circle. It is important that this circular row or the arcs be close to the peripheral edge of the pad and be set in from the edge about the width of the row itself.

The remainder of the pad which is not occupied by the rows of bristles 47 and 48 is made up of the looped pile 46. It is these portions of the total pad surface which pick up and retain the dirt which is primarily loosened by the bristles. The exposed loops 46 form an extremely dense surface to perform a cleaning action but dirt is nevertheless retained under this firm surface.

The radial rows of bristles 47 perform an excellent scrubbing action on the floor or carpet and in this respect supplement the cleaning action of the looped piles 46. On the other hand, the arcuate or circular row of bristles 48 exert a novel stripping action which cleans close to a wall and brings the dirt inwardly toward the center of rotation so that it is picked up by the loops 46. The combined cleaning action of the scrubbing radial bristles at 47 and the stripping arcuate fibers at 48 perform a synergistic cleansing result. The use of the pad of this invention makes it possible to do a better cleaning job in a shorter length of time. This of course means that a floor or carpet can be cleaned at a lower cost.

Another distinct advantage of the addition of the arcuate fibers is that their orientation around the periphery of the pad, in addition to the radial fibers enable stripping and/or scrubbing to be performed in two directions simultaneously. In actual use the floor machine is moving either left to right and right to left; or forward to back and back to forward. Thus, the orientation of fibers radially and arcuately (see 47 and 48 in FIG. 3) enables this unique action to occur in 2 directions simultaneously.

As stated above, the pad of this invention is shown with the machine of my patent for illustration purposes, but the pad can be used with any rotary floor and carpet machine of this general type. Variations may be made in the relative size of the fibrous sections and the hooked strand sections but in general the illustrated proportions are preferred. As stated, the "hooked rug" sections present a firm, hard surface in contrast to a soft, shaglike construction and this feature, combined with the radial and outer curved sections of fibrous bristles account for the superior cleaning action of the pad.

Another variation within the scope of this invention is that instead of supporting the pile in a base sheet by hooking the fibers and strands in it, the fibers and strands can be glued to a base sheet. Pads of this general type are known and they utilize a thick adhesive coating on a fabric in which the pile material is held by glue.

I claim:

1. A carpet cleaning pad for rotary floor cleaning machines comprising a disc of a base sheet material and supported therein the following: an annular strip of fibrous bristles around the periphery of the disc, a plurality of substantially radial strips of fibrous bristles and a bed of firmly looped strands woven to a hooked rug solidity to present a compact cleaning surface filling in the remaining areas within said annular strip.

2. The carpet cleaning pad of claim 1 in which said annular strip of fibrous bristles is a continuous circular band.

3. The carpet cleaning pad of claim 1 in which said annular strip of fibrous bristles is a series of arcs to form a discontinuous interrupted circular band.

4. The carpet cleaning pad of claim 1 in which said annular strip of fibrous bristles is located inwardly from the periphery about the width of the strip itself.

5. The carpet cleaning pad of claim 1 in which the fibrous bristles are looped through the base sheet so their free ends are on the same side of the base sheet as the strand loops forming the cleaning pile.

6. The carpet cleaning pad of claim 1 in which the base sheet is a non-woven fabric.

7. The carpet cleaning pad of claim 1 in which said strips of fibrous bristles are from five to eight percent of the diameter of the pad in width.

* * * * *